United States Patent [19]

Beukes et al.

[11] Patent Number: 4,976,199

[45] Date of Patent: Dec. 11, 1990

[54] BLASTING SYSTEM AND ITS METHOD OF CONTROL

[75] Inventors: Christo A. Beukes; Vivian E. Patz; Thrasyvoulas Moraitis, all of Johannesburg, South Africa

[73] Assignee: Expert Explosives (Proprietary) Limited, South Africa

[21] Appl. No.: 398,890

[22] Filed: Aug. 28, 1989

[30] Foreign Application Priority Data

Sep. 1, 1988 [ZA] South Africa ..... 88/6500

[51] Int. Cl.[5] ..... F42D 1/055

[52] U.S. Cl. ..... 102/200; 102/217; 102/301; 102/310; 102/311; 181/106; 181/112; 181/116

[58] Field of Search ..... 102/301, 305, 308, 310, 102/311, 200, 217; 367/144, 145, 55, 103; 181/106, 115, 116, 117, 107, 112

[56] References Cited

U.S. PATENT DOCUMENTS

| | | | |
|---|---|---|---|
| 2,708,877 | 5/1955 | Smits | 361/248 |
| 2,881,703 | 4/1959 | Volpert | 361/243 |
| 3,018,732 | 1/1962 | Tognola | 102/202.8 |
| 3,019,732 | 2/1962 | Kaspaul | 102/202.8 |
| 3,196,041 | 7/1965 | McNutty | 437/15 |
| 3,211,096 | 10/1965 | Forney | 102/202.5 |
| 3,292,537 | 12/1966 | Goss, Jr. | 102/202.9 |
| 3,361,064 | 1/1968 | Johnson | 102/202.3 |
| 3,659,527 | 5/1972 | Abegg et al. | 102/202.7 |
| 4,037,537 | 7/1977 | Thorsell et al. | 102/22 R |
| 4,037,538 | 7/1977 | Andrews et al. | 102/23 |
| 4,313,380 | 2/1982 | Martner et al. | 181/116 |
| 4,484,523 | 11/1984 | Smith et al. | 102/202.5 |
| 4,699,241 | 10/1987 | Kerekes | 181/116 |
| 4,819,560 | 4/1989 | Patz | 102/202.5 |

FOREIGN PATENT DOCUMENTS

| | | |
|---|---|---|
| 2747163 | 4/1979 | Fed. Rep. of Germany . |
| 3322990 | 1/1985 | Fed. Rep. of Germany . |
| 3537820 | 4/1987 | Fed. Rep. of Germany . |
| 2075028 | 10/1971 | France . |
| 2123122 | 1/1983 | United Kingdom . |

*Primary Examiner*—Charles T. Jordan
*Assistant Examiner*—Rochele Lieberman
*Attorney, Agent, or Firm*—Spencer & Frank

[57] ABSTRACT

A blasting system wherein the actuation of detonators at a plurality of blast holes is controlled by firing one or more test blasts and, at each blast hole, monitoring the resulting shock wave to derive data which is used to determine time delay criteria for the blast holes.

Each detonator includes a shock sensitive device which detects the shock wave. Each detonator has on-board signal processing capability and optionally is connected to a central control computer.

5 Claims, 4 Drawing Sheets

BLASTING SYSTEM AND ITS METHOD OF CONTROL

BACKGROUND TO THE INVENTION

This invention relates generally to a blasting system and to a method of controlling a blasting operation and, in particular, to a detonator firing element for use in such system or method.

South African Pat. No. 87/3453 describes a detonator which incorporates a detonator firing element which includes an integrated circuit with a very low energy dissipation device which is adapted to cause initiation of a primary explosive. This type of detonator lends itself to inclusion in a blasting system which is well protected against spurious effects and misfires and which, with a plurality of similar detonators and a control computer, can be connected in a bi-directional communications network which enables a blast sequence to be accurately controlled in accordance with pre-determined data.

SUMMARY OF THE INVENTION

The present invention is concerned, in the first instance, with an alternative approach to the problem of controlling a blasting operation.

The invention provides a method of controlling a blasting operation which includes the steps of initiating at least a first blast, monitoring a shock wave produced at least by the first blast, and using information derived from monitoring the shock wave to control the initiation of at least a second blast.

The second blast may be initiated in a controlled manner to interfere with the first blast. 'Interfere', in the context in which this word is used in this specification, includes a process wherein shock wave patterns are taken into account in such a way that a desired composite effect is achieved. Thus the interference of a subsequent blast with an earlier blast may be constructive, and so tend to reinforce the blast and its vibratory effects, or destructive, and so produce a blast but in such a way that the aftermath vibrations are minimised.

The first blast and the second blast may be at respective first and second locations which are spaced from one another. The first shock wave may be monitored at the second location. Thus the shock wave monitored at the second location is dependent at least on the distance between the first and second locations and on the physical conditions and characteristics of the material between the first and second locations and through which the shock wave is propogated.

At a given location a plurality of earlier shock waves may be monitored and information derived therefrom may be used to initiate a blast at this location. With this approach there is provided the ability to synchronise a subsequent blast to one or more earlier shock waves thereby creating complex shock wave patterns in the material being blasted.

In an alternative approach a shock wave monitored at a particular location is used immediately or with a delay to initiate a blast at such location.

In both approaches each subsequent blast is dependent on actual physical conditions prevailing at the time and at the respective blast location and, as the blast control is essentially effected in real time, each subsequent blast may be controlled so as to interfere in a desired manner with one or more earlier blasts.

A variation of the invention includes the steps of transmitting data derived from monitoring the shock wave from each of the monitoring locations to a central location, calculating delay periods associated with the respective monitoring locations at the central location, transmitting information on the delay periods to each of the monitoring locations, and controlling a sequence of blasts at the respective monitoring locations with a respective delay period being associated with each blast at a respective monitoring location.

Through the use of the aforementioned method it is possible in a mining operation to break rock in a controlled way thereby to achieve rock fragments of a controlled pre-determined size. These rock fragments may be delivered, i.e. parted from a rock face, in a way which simplifies their subsequent removal. The rock face and hanging and footwalls may be left in good condition and thereby the need for roof bolting or rock support or stabilization may be minimised. Through constructive interference of shockwave patterns produced by a plurality of controlled blasts, a net blast effect may be maximised and in this way the use of explosives to achieve a predetermined blasting displacement may be optimised. Alternatively by controlling blasts to interfere destructively with one another vibrational shock waves which are transmitted through a rock body and the aftermath of the blast may be minimised in amplitude thereby to limit the effect of the vibrational waves.

It is apparent that the aforementioned method may be adapted to achieve one or more of a plurality of objectives. A primary objective may for example be to break rock in a controlled way thereby to achieve a pre-determined rock fragment size. This objective may however be inconsistent with a good rock throw i.e. the displacement of the loosened rock fragments from the mother rock face. Thus it falls within the scope of the invention to use the aforementioned method and, thereafter, to make use of a secondary blasting process to move or displace loosened rock fragments from a rock face. Both sets of explosives are however preferably placed at the same time. For example a first set of sequentially fired explosives may be fired in rapid sequence to increase the percussive effect and to promote rock cracking, and a second set of sequentially fired explosives may be fired at a slower rate, in a substantially different time scale, to lift and remove the rock, essentially using gas pressure effects rather than percussive action.

The invention also extends to a detonator firing element which includes means for detecting at least one shock wave produced by an earlier explosive blast, explosive, and means responsive to the detection means for initiating the explosive.

The detection means may be used to detect a plurality of shock waves or shock wave peaks produced by a plurality of earlier explosive blasts.

The detection means may function in any suitable way. Thus any appropriate sensor which responds to shock wave effects may be employed in or as the detection means. Suitable effects which may be made use of for this purpose are:

(a) an electromagnetic effect in which relative movement between a conductor and a magnetic field produces an electromotive force in the conductor. This electromotive force is dependent on the shock wave.

(b) an electro-static approach wherein structural deformation, due to pressure variations, produces an electrical charge or variation. For example a piezoelectric crystal may be used.

(c) objects or components which exhibit a change in an electrical parameter such as resistance, inductance or capacitance during movement or deformation may also be used to provide detection means which is responsive to a shock wave.

The sensor which is used may be included on a suitable substrate as an integrated component, with the substrate including an integrated electrical circuit.

In a preferred form of the invention use is made of an accoustic type sensor to detect a shock wave. Such a sensor responds to pressure wave variations associated with the shock wave. The transducer may for example be a piezoelectric polymer such as polyvynilidene fluoride which is also known as PVDF. This type of material in tubular or plate form, or in any other suitable form, with electrodes formed on opposing surfaces, acts as a microphone and responds to pressure variations by producing an electrical signal between its electrodes.

The means for initiating the explosive may be of any suitable type but preferably is of a general kind described in the specification of South African Pat. No. 87/3453. A device of this kind, which incorporates a large scale integrated circuit, carries the capability of incorporating on-board complex signal processing resources and formed integrally with the circuit is a 'hot-spot', which dissipates energy for explosive initiation purposes.

It is to be understood though that the device described in the specification of South African Pat. No. 87/3453 is given only by way of example and that any appropriate device could be used. Thus the 'hot-spot', for example in the form of a bridge wire, exploding bridge wire, fusible link or the like, can be provided as a separate component, which is not unitary with the integrated circuit.

The integrated circuit may include a control system which prevents the detonator firing element from being fired without first being tested, loaded with a time delay, and armed.

A detonator firing element which includes signal processing capability lends itself to incorporation in a bi-directional communications arrangement which achieves highly accurate timing control of the individual detonator firing elements and provides adequate safety interlocks within the system. Thus, within such a system, a detonator which is formed from the detonator firing element mounted to a housing which contains explosive material is safe to transport and handle when not activated and the explosive initiating means is responsive to the detection means only once that particular status has been reached within the system.

The invention further extends to a blasting system which includes a plurality of blast holes, explosives in the respective blast holes, a plurality of detonators of the kind described associated with explosives in the respective blast holes, and each detonator being arranged to initiate each respective explosive in a controlled manner upon detecting one or more shock waves produced by an earlier explosive blast or blasts.

As has been pointed out such a system may include a second plurality of explosives arranged to displace rock, fragmented by a first plurality of explosives, from a rock face.

In the aforementioned blast system there are two possible approaches at least to controlling the initiation of explosives. In the first instance blasts can be initiated essentially on a real time basis in that a given detonator firing element will be caused to initiate upon detecting a shock wave or a plurality of shock waves. If desired this approach can be coupled with a time delay which extends between the detection criterion and the actual initiation of explosion.

In a second approach a test detonation, or several test detonations arranged in a suitable geometric pattern, and initiated simultaneously or in sequence, is used to create a test blast and at each of the detonator firing elements shock waves are monitored to assess physical characteristics of the material between the blast holes. Also monitored are the time delays associated with a shock wave produced by the test blast and extending between successive blast holes. In this technique the information may be supplied to a control means which is used in a predictive calculating system to forecast a blasting sequence taking into account the prevailing physical characteristics and desired effect, in order to achieve a pre-determined objective.

BRIEF DESCRIPTION OF THE DRAWINGS

The invention is further described by way of examples with reference to the accompanying drawings in which.

DESCRIPTION OF PREFERRED EMBODIMENT

Figure 1:
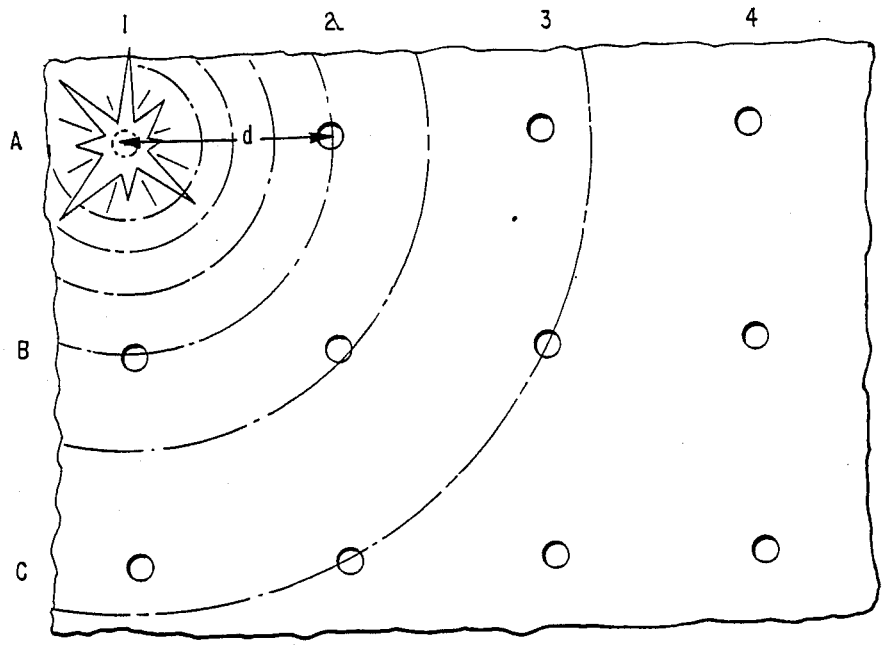
FIG. 1 schematically depicts an array of blast holes in a blasting system according to the invention.

FIG. 1 illustrates a blast hole pattern in a rock quarry. In this instance the blast holes are arranged in a rectangular pattern with rows being numbered alphabetically and columns being numbered numerically. Assume at a given time a single blast is initiated at the blast hole A1. Shock waves radiate outwardly from the blast hole and travel through the rock body.

Figure 2:
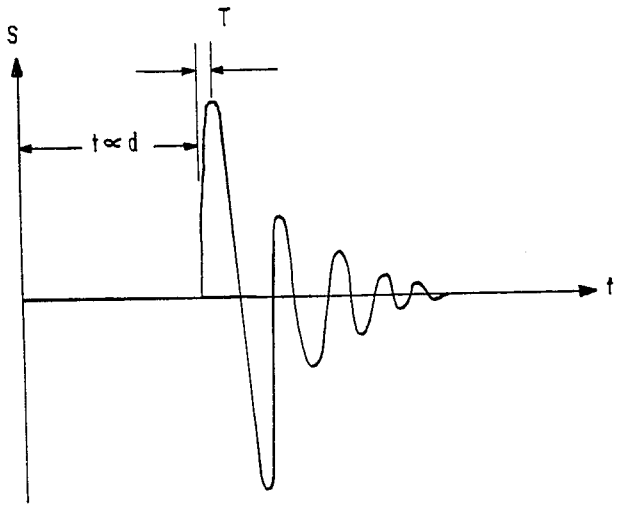
FIG. 2 is a graphic representation of a shock wave travelling through a rock body.

A typical shock wave pattern is illustrated in FIG. 2. The shock wave has a very sharp leading edge and exhibits oscillatory behaviour with a dampened amplitude. Referring for example to the hole A2 which is a distance d away from A1 the leading edge of the shock wave reaches the hole A2 at a time t which is dependent on the distance d. Sound in rock travels at a speed of from 3000 to 6000 meters per second and consequently for a hole spacing d of the order of one meter the time t is from 166 to 330 microseconds.

The rise time of the leading edge of the shock wave is of the order of 10 nanoseconds while the width of the pulse is of the order of 1 microsecond.

Still referring to FIG. 2 assume that a blast is initiated at the hole A2 at a time T after the leading edge of the shock wave is detected. In this example T is very much less than t and it will be readily understood that despite the time lag in detecting the leading edge of the shock wave and the time lag in triggering a detonation at the hole A2 there is nonetheless sufficient time for an explosive to be initiated at the hole A2 so that its resulting shock wave reinforces the shock wave arriving from the hole A1.

It is apparent that the process described can be repeated in one or more of the remaining holes, so that a blast at each hole can be initiated in a controlled manner dependent on the shock wave which originates from a selected hole, in this case A1.

Blasts following the blast in the hole A1 also set up shock waves which travel through the body of rock. Clearly a stage is reached at which the shock waves superimposed on one another form a highly complex pattern. Nonetheless it is generally possible to distinguish peaks within the complex pattern which can be used for the synchronisation of subsequent blasts.

Figure 3:
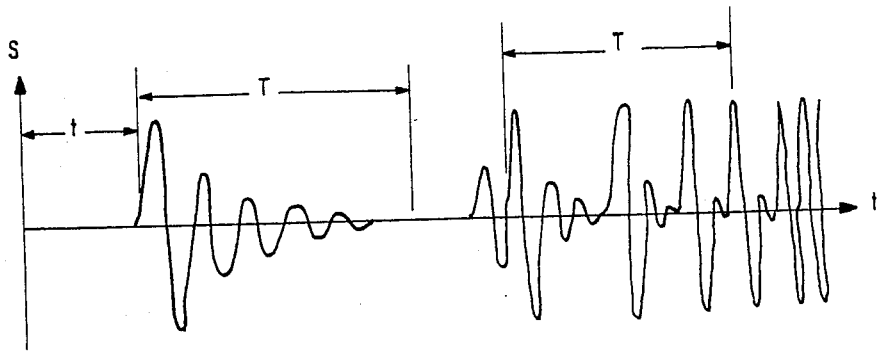
FIG. 3 is a representation, similar to that contained in FIG. 2, of a complex shock wave pattern generated by multiple blasts, FIG. 4 schematically depicts a detonator firing element for use in the blast system of the invention.

FIG. 3 illustrates, on the left hand side, a shock wave pattern which is similar to that shown in FIG. 2 where the time delay T, before a blast is initiated following on detection of the shock wave, is large compared to t.

The right hand side of FIG. 3 shows a complex shock wave pattern which originates within the rock body when a number of successive shock waves are superimposed on one another. A distinct series of peaks remains visible despite the complexity of the signal between the peak values.

Figure 4:
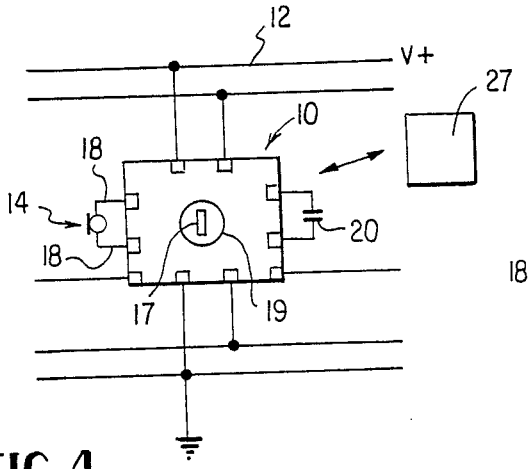

FIG. 4 illustrates a detonator firing element 10 which may be of the kind described in the specification of South African Pat. No. 87/3453 and which consequently is not described in detail herein. The detonator firing element includes a large scale integrated circuit or a very large scale integrated circuit which provides on board signal processing capabilities and inherent safety functions. The detonator firing element is connected to control and power supply lines 12 in a manner which enables bi-directional communications to be established between the detonator firing element and a control computer, not shown.

Figure 5:
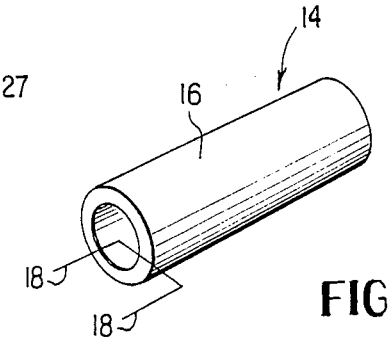
FIG. 5 illustrates a sensor for use in the detonator firing element of FIG. 4.

In this example of the invention a sensor 14 is connected to control terminals of the detonator firing element 10. As has been described hereinbefore the sensor 14 may be of any suitable type but preferably is of an accoustic type and, more particalarly, is formed from a piezoelectric polymer such as PDVF. A suitable form of construction is shown in FIG. 5 which depicts a tubular body 16, the inner and outer sufaces of which are metallicly coated to provide electrodes to which are attached leads 18 which facilitate the connection of the sensor 14 to the integrated circuit.

Figure 6:
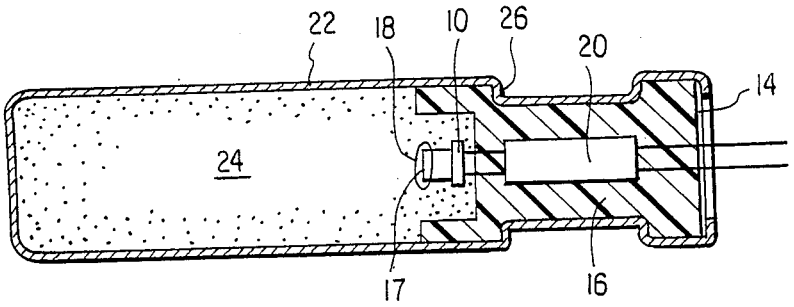
FIG. 6 illustrates one possible form of physical construction of a detonator which incoporates the sensor shown in FIG. 5, and FIGS. 7 to 9 respectively depict flow charts of different blast control systems.

A fusible link 17 is formed integrally with the integrated circuit and explosives material 19 is deposited over the link 17. It is to be understood though that, as is shown in FIG. 6, the link 17 could be a discrete component, which is displaced from the integrated circuit, and which has the explosives material 19 adhering to it.

The sensor 14 when exposed to pressure variations of the type produced by a blast shock wave produces an electrical signal across the leads 18 of the kind shown in FIGS. 2 and 3. The electrical circuit of the detonator firing element is able to monitor the signal and detect the type of sharp leading edge shown in FIGS. 2 and 3. The number of shock wave peaks can thus be counted and the count can be used to control the firing of the blasts. It can in general be said that the integrated circuit monitors the rate of rise of the leading edge and also the amplitude of the leading edge and when predetermined criteria are met generates an output signal to indicate that a pre-determined set of conditions has been met which correspond to the detection of a shock wave.

The circuit shown in FIG. 4 includes a capacitor 20. As shown in FIG. 6 the capacitor 20 may be mounted within the tubular body 16 shown in FIG. 5 and the detonator firing element 10 may also be located within the tubular bore of the body. FIG. 6 illustrates a detonator can 22 which contains conventional explosives material 24. The tubular body 16 is located in an open end of the can which is then crimped as is shown by a deformation 26 thereby to secure the components to One another in a satisfactory manner and to seal the detonator can.

The principles of the invention may be used in a number of ways. In the first instance it is possible, in the manner described, to detect a shock wave originating from a pre-determined blast hole. According to predetermined criteria a subsequent blast is initiated in order to interfere, either constructively or destructively, with the primary shock wave. In this way the primary shock wave may be maximised or secondary vibratory effects may be minimised. With this approach delays may be in the order of up to 1000 microseconds.

The blast at each subsequent hole will in general terms depend on detecting the primary shock wave. This approach avoids the problem of discriminating a required shock wave from what may be a cluttered shock wave pattern arising inter alia from spurious reflections and superimposed shock waves produced by multiple delayed blasting procedures. Thus the first or primary shock waves calibrate the system, taking into account the actual geometry and the physical parameters of the system and all subsequent blasts are synchronized to the first shock wave and occur substantially immediately or a controlled time delay later.

In a second application of the principles of the invention the detected shock wave is used to increment a shock counter which is not shown as a separate component but which is programmable and which is carried onboard the integrated circuit in the detonator firing element 10. This feature provides the ability to synchronize blasts within an array to more than one shock wave thereby creating complex shock wave patterns in the rock body. This feature also allows the adoption of longer time delays whilst still working in a synchronized manner. The signal processing requirements in this approach are complex and are only possible by using the power of very large scale integrated circuits.

As has been pointed out FIG. 2 depicts the situation in which a primary shock wave is used to cause initiation of explosives at each of a plurality of blast holes, with a blast at each hole taking place a relatively short time T after detection of the leading edge of the shock wave. In FIG. 3 the time T is large compared to the time t. In other words there is a significant time delay, calculated to achieve a desired effect, before a subsequent blast is initiated. Also shown in FIG. 3 is a technique wherein a plurality of peaks are detected before a blast is initiated. In this case the time delay T is generally speaking substantial compared to the situation occurring with FIG. 2.

Complex control features are incorporated on the integrated circuit of the detonator firing element to prevent an element from firing without first being tested, loaded with a delay, and armed. The control system implemented may be of any suitable type and may for example be based on the use of bi-directional communication techniques as described in the specification of South African Pat. No. 87/3453. When communication facilities are designed for, the information produced by each shock sensor is transmitted along the lines to a control computer 27, see FIG. 4, which calculates delay period criteria according to predetermined formulas and which transmits information on the delay periods to the respective detonators.

The detonator firing element is, in addition, only responsive to a signal detected by the sensor 14 once the appropriate circuitry has been enabled. Thus the detonator firing element can be used to initiate an explosive only once fully armed and primed but, on the other hand, the detonator firing element is de-sensitized and safe to transport and handle when not activated.

A primary advantage of the invention is that it enables a blasting procedure to be implemented which can be tailor-made, in real terms, to prevailing physical conditions in order to meet desired objectives. This removes the need to produce a mathematical model of the rock body in order to implement a predictive approach. It is also possible however to implement a system which really is a combination of the predictive and the real time approaches. Thus it falls within the scope of the invention to provide a blasting system which makes use of the various components described thus far. Initially the various detonator firing elements are not activated but are nonetheless capable of recording information detected by the sensors 14 and of transmitting this information to a central collecting point controlled by means of a computer. Under these conditions if a test blast is triggered off at a desired point then the information coming in on the control lines 12 can be collected and analysed in order to arrive very quickly at a model of the rock body which is based on actual measurements. Depending on these measurements and depending on the desired blast pattern and blasting effect the various detonator firing elements can be pre-programmed from the central computer to fire in a particular manner. Thus the on-board sensors are used mainly in an information collecting role and a blasting procedure is then determined through the use of the central computer which programmes the detonator firing elements accordingly.

The process described thus far makes it possible to implement a blast control procedure wherein rocks may be fragmented to a controlled degree. This approach will not necessarily displace the rock fragments from a rock face and, to achieve this, the invention provides a secondary phase wherein use is made of secondary strategically located explosives which are designed to displace the rock from the rock face in order to facilitate the collection of the rock. In the second phase sequenced explosives are initiated relatively slowly, compared to the first phase, so that reliance is placed more on gas pressure effects to achieve rock displacement, rather than on percussive effects.

The invention has been described with reference to the use of a particular form of detonator firing element and sensor. Obviously other equivalent devices could be used and the invention therefore is not confined to the particular embodiment described and illustrated hereinbefore.

Figure 7:
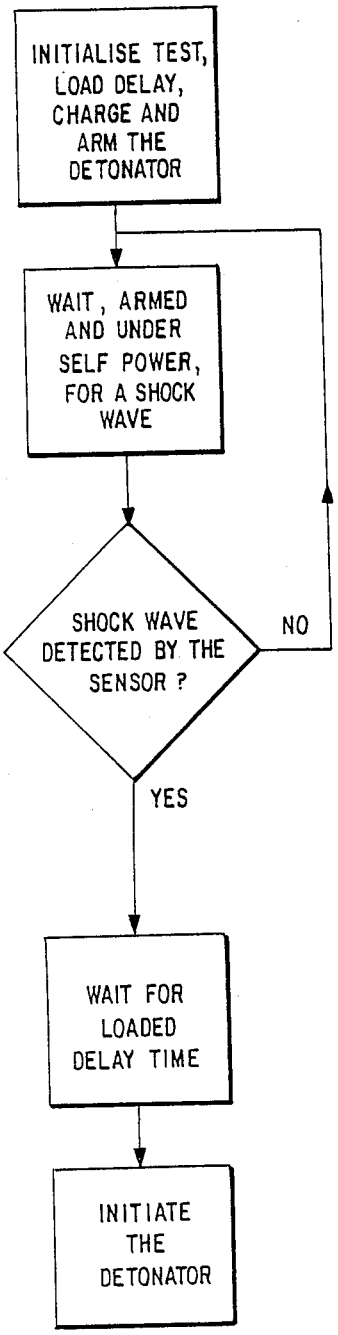
Figure 8:
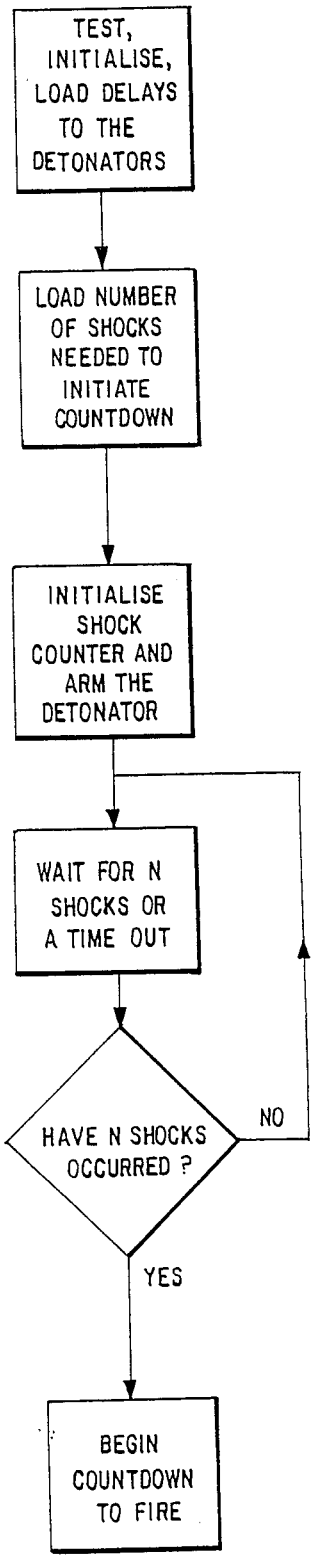
Figure 9:
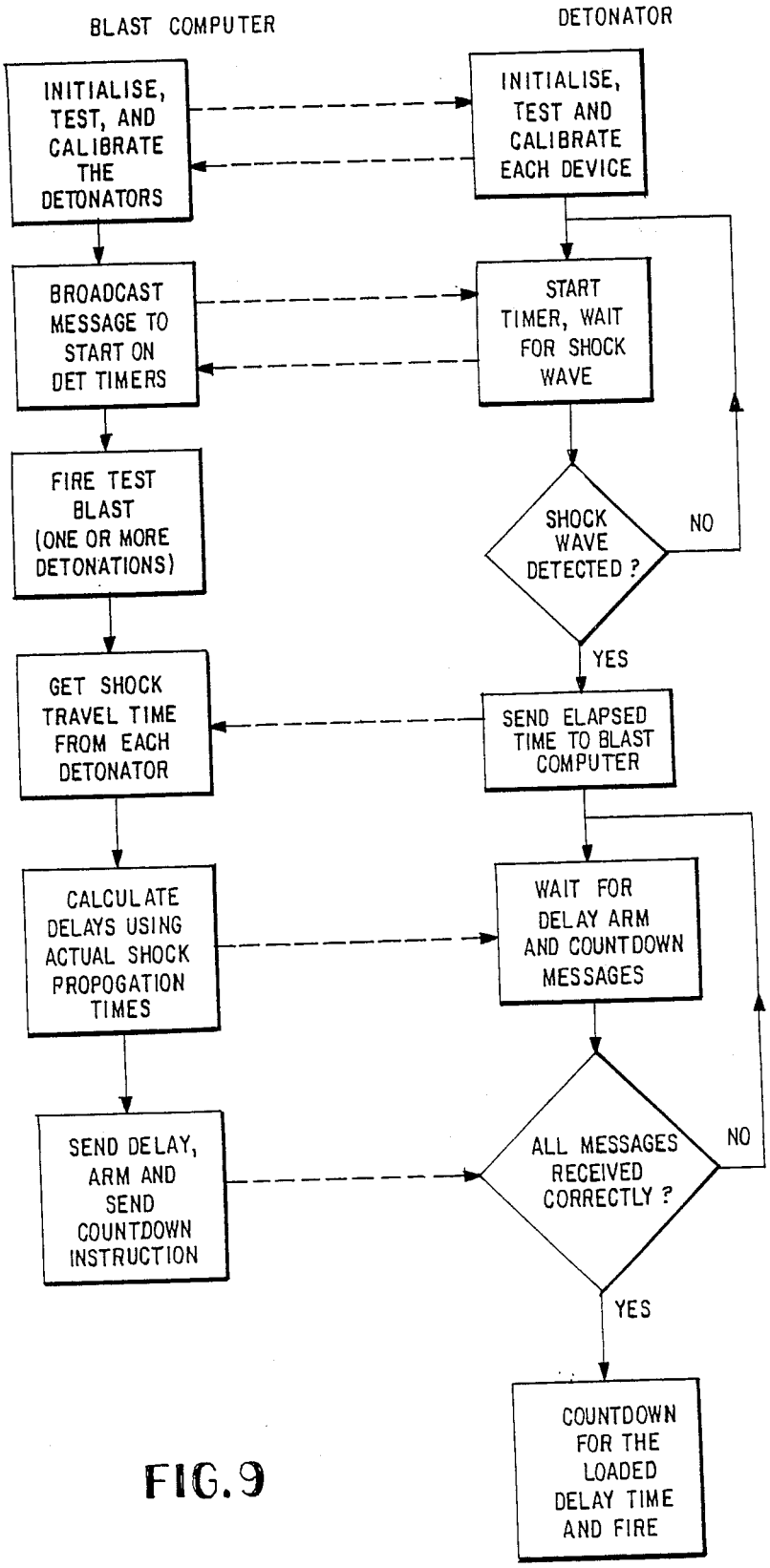

FIGS. 7 to 9 respectively depict three flow charts of different sequences of operations in detonation processes. In implementing the detonation processes, as emerges hereinafter, use may be made of a central control computer, the signal processing capability on each detonator firing element, or a combination thereof. The development of the software lies within the scope of those persons who are skilled in the art and the precise nature of the software is consequently not detailed herein. In dealing with a blasting sequence which is computer controlled it is to be understood that the control instructions may be implemented purely by software means, or by hardware means, or by a combination thereof. When very large scale integrated circuits are carried onboard the detonator firing elements the signal processing capability of such circuits may be substantial and logical steps, subject only to the input of critical parameters from an external source, for example from an external control computer, may be implemented directly through hardware i.e. by appropriate design of the circuit itself.

FIG. 7 illustrates a basic application of the principles of the invention. Each detonator which comprises for example a device of the kind shown in FIG. 6, i.e. a detonator firing element (FIG. 4) mounted in a can together with explosive, is tested, loaded with a delay, and armed under the control of a blast programmer. The detonator then enters a state during which it draws power from an internal power source such as the capacitor 20.

While the detonator is internally powered it waits for the shock wave from the first blast and once this is detected progresses through the loaded time delay before directing current from the internal power source to the 'hot-spot' i.e. the fusible link 17 (in this example).

The flow chart of FIG. 8 is in respect of a more complex situation. In this case the detonator is intended to detect N peaks of shock waves before commencing the countdown to fire. Each detonator firing element (FIG. 4) carries in its integrated circuit an algorithm which indicates a method in which a number N is loaded into the detonator prior to arming. This number N is the number of peak shock waves which are to be detected prior to the initiation of countdown.

Once the detonators have been tested and initialized the delays and the number N are loaded into the detonators. The shock counter is initialized so that it is responsive to peak shock waves. After N shock waves have been detected the countdown is commenced.

With this approach a substantial amount of processing power resides in the integrated circuit and, where necessary, signal processing techniques are resorted to, to screen out clutter and noise.

The flow chart of FIG. 9 depicts a blast system in which a test blast is used to generate information which is detected by a plurality of detonators, as has been described hereinbefore. The information from the various detonators is returned to a central or blast computer and individual time delays for the respective detonators are calculated by the blast computer. This information is returned to the detonators in readiness for a subsequent arm and countdown message.

The system depicted in FIG. 9 can be implemented on a real-time basis or with a relatively long time-delay between the initial test blast and the subsequent firing of the various detonators.

The left-hand side of the flow chart of FIG. 9 depicts the steps at the blast computer. Thus the blast computer is used firstly to initialize, test and calibrate the detonators which are arranged in a predetermined blast pattern. When a test blast is fired, and this may comprise one or more detonations, timers on the integrated circuits of the detonators are commenced and, from each detonator, an indication of the time taken for the shock wave to propagate through the rock to the detonator is obtained. The central computer utilises the information together with other data relating to the rock body and, in order to achieve a desired blast pattern, calculates the respective delay times for each detonator. The delay times are then transmitted to the respective detonators and, at an appropriate time, the detonators are armed and then sent countdown instructions.

The right-hand side of the flow chart of FIG. 9 shows the sequence of steps at each of the detonators. In the light of the preceding description the steps are readily followed.

The detonators are thus used to measure the time delay of a shock wave propagating through the rock body. The information is sent to the central computer for analysis and the ideal delays are then calculated by the computer. Once the delays have been loaded into the detonators they can fired as required.

It is apparent that as use is made of a central computer for calculating the delays for all of the detonators the computing power on each detonator may be reduced.

The preceding flow charts have been given only by way of example and various modifications and amendments may be made thereto to achieve different effects and in order to vary the computing power required onboard each detonator.

We claim:

1. A method for controlling a blasting operation, comprising:

initiating at least a first blast at a first location;

monitoring a shock wave produced by at least the first blast at each of a plurality of monitoring locations which are spaced from the first location;

transmitting data derived from monitoring the shock wave from each of the monitoring locations to a central location;

calculating delay periods associated with the respective monitoring locations at the central location;

transmitting information on the delay periods to each of the monitoring locations; and controlling a sequence of blasts at the respective monitoring locations, each blast at each respective monitoring location having a respective delay period associated therewith.

2. A method according to claim 1, wherein said controlling step includes initiating a blast at each monitoring location after a predetermined delay period has elapsed from the time the first blast is detected at the respective monitoring location.

3. A method according to claim 1, wherein said controlling step includes initiating a blast at each monitoring location after a predetermined delay period has elapsed from the time a predetermined number of shock wave peaks are detected at the respective monitoring location.

4. A method according to claim 1, wherein said controlling step comprises initiating at least first and second blast sequences at the monitoring locations, the first blast sequence taking place rapidly relative to the second blast sequence.

5. A method according to claim 1, wherein said controlling step includes controlling the sequence of blasts so that at least one sequence of blasts occurs at each respective monitoring location.

* * * * *